United States Patent [19]

Grider

[11] Patent Number: 4,746,114

[45] Date of Patent: May 24, 1988

[54] ADJUSTABLE SEAT ASSEMBLY FOR EXERCISE APPARATUS

[75] Inventor: Sherman P. Grider, Walnut, Calif.

[73] Assignee: Bollinger Industries, Irving, Tex.

[21] Appl. No.: 915,987

[22] Filed: Oct. 6, 1986

[51] Int. Cl.[4] ..... A63B 17/00

[52] U.S. Cl. ..... 272/123; 272/117; 272/134; 272/144; 297/377

[58] Field of Search ..... 272/93, 117, 118, 123, 272/134, 144, 145, DIG. 4; 297/346, 377

[56] References Cited

U.S. PATENT DOCUMENTS

| | | | |
|---|---|---|---|
| 194,477 | 8/1877 | Smith et al. | 297/377 |
| 741,121 | 10/1903 | Fisher | 297/377 X |
| 3,761,127 | 9/1973 | Giese et al. | 297/346 |
| 4,546,967 | 10/1985 | Kecala | 272/144 X |
| 4,635,934 | 1/1987 | Roethke | 272/123 X |
| 4,641,837 | 2/1987 | Ruth | 272/123 |
| 4,653,751 | 3/1987 | Green | 272/123 X |

FOREIGN PATENT DOCUMENTS

| | | | |
|---|---|---|---|
| 3423837 | 1/1986 | Fed. Rep. of Germany | 272/123 |
| 2106399 | 4/1983 | United Kingdom | 272/144 |

*Primary Examiner*—Alfred C. Perham
*Assistant Examiner*—Richard E. Chilcot, Jr.
*Attorney, Agent, or Firm*—Boniard I. Brown

[57] ABSTRACT

An adjustable seat assembly for exercising apparatus which may embody a hand-held weight frame, a movable weight supporting frame, a leg exercise unit or other exercise device. The seat assembly has an elongate seat mounted on a base for endwise adjustment relative to the base to accommodate the seat to various exercise devices. The seat has a seat portion, a back portion, and means including an arcuate support extending between the back portion and base and movable endwise relative to the base of pivotally adjusting the back portion relative to the seat portion to a range of angular positions between an upright position and a downwardly inclined position.

7 Claims, 2 Drawing Sheets

ADJUSTABLE SEAT ASSEMBLY FOR EXERCISE APPARATUS

BACKGROUND OF THE INVENTION

1. Field of the Invention

This invention relates generally to exercise apparatus of the kind having a bench on which a person sits or reclines while using exercising devices such as hand-held weights, frame supported weights, a leg exerciser, or other exercising device. The invention relates more particularly to a novel adjustable bench assembly for such exercise apparatus.

2. Prior Art

The adjustable bench assembly of the invention is designed for use with a variety of basic exercise apparatus types and devices. Among these are the following.

Exercise apparatus having an upright support for a hand-held weight which may be removed from the support, used for exercising, and then returned to the support by a person sitting or reclining on a bench positioned adjacent the support.

Exercise apparatus having an upright frame supporting a number of individual weights which are movable vertically up and down the frame. Means are provided for selectively coupling two or more of the weights together to provide a selected combined weight which is raised and lowered relative to the frame by a person sitting or reclining on a bench positioned adjacent the frame. In this case, the exercise apparatus may be equipped with a variety of exercise devices, such as foot stirrups, hand grips, handlebars, pivotal leg exercisers, and the like, which are directly connected or connected by cables to the weights for exercising various parts of the user's body.

Exercise apparatus having a leg exerciser pivotally mounted on one end of a bench for use by a person sitting or reclining on the bench.

The existing exercise apparatus of this kind all have benches for supporting the user of the apparatus in a sitting or reclining position. The existing benches, however, are either simple horizontal benches which are not adjustable to support the user in different sitting and reclining altitudes or, if adjustable, are relatively complex and costly. Moreover, the existing adjustable exercise benches are restricted in their range of adjustment. Moreover, at least the adjustable benches are in most if not all cases confined to use with a specific exercise apparatus. Accordingly, a need exists for an improved exercise bench which avoids the above noted and other deficiencies of the existing exercise benches.

SUMMARY OF THE INVENTION

This invention provides such an improved exercise bench of the character described. The improved bench is essentially a bench assembly having a bench proper and a bench supporting base. According to one feature of the invention, the bench is supported on the base for adjustment relative to the base in a manner which accommodates the bench to use with all of the earlier described and other types of exercise apparatus, especially those having hand-held weight supports, weight supporting frames, and pivotal leg exercisers. This adjustment permits the bench to be adjusted toward and away from the weight support or weight frame to permit the user to perform various kinds of exercises using the apparatus weights.

According to another feature of the invention, the bench has a seat portion, a backrest portion referred to herein simply as a back portion, and novel means supporting the back portion on the seat portion for angular adjustment about a pivot axis relative to the seat portion. This back support means includes an arcuate support member extending between the back portion and the base of the bench and movable endwise of the member, substantially about the pivot axis during angular adjustment of the back portion. Releasible back means are provided to secure the support member against endwise movement relative to the base and thereby secure said back portion in a fixed angular position relative to seat portion of the bench. The back portion is adjustable between an upright position to support the user in a sitting position on the bench and a downwardly inclined position to support the user in a reclining position with his head and back inclined downwardly relative to his lower body.

DESCRIPTION OF THE PREFERRED EMBODIMENT

Figure 1:
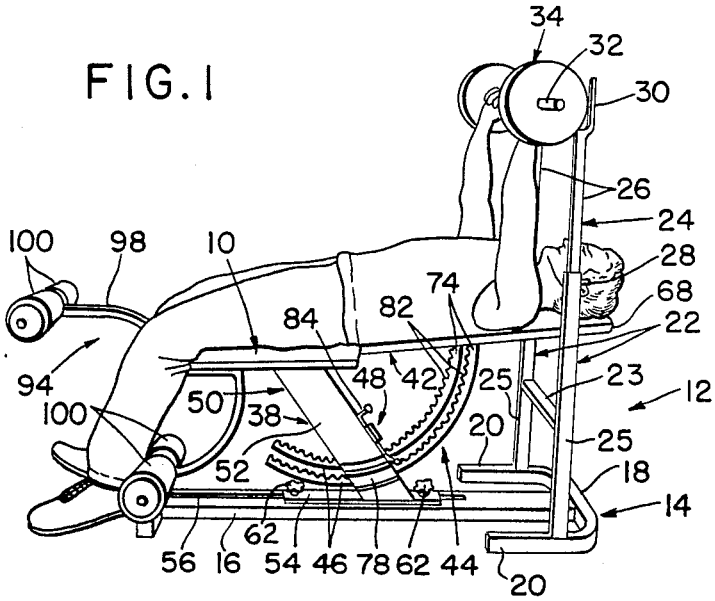
FIG. 1 is a perspective view of an improved exercise bench according to the invention installed in an exercise apparatus for use with hand-held weights and embodying a leg exerciser and showing the bench adjusted to support the user in a ining position.

Turning first to FIGS. 1–5 of these drawings, there is illustrated an improved exercise bench assembly 10 according to the invention installed in an exercise apparatus 12. The exercise apparatus is conventional except for this improved bench assembly.

Exercise apparatus 12 comprises a base 14 including an elongate base member 16. Welded or otherwise rigidly joined to one end of the base member 16 is a cross member 18 having outboard ends 20 which are turned 90° to extend toward the opposite end of the base member.

Rigidly joined at their lower ends to the outboard ends 20 of the cross member 18 are two parallel upright posts 22 joined by a cross member 23 to form a barbell weight support frame 24. Each post has a lower section 25 welded or otherwise rigidly joined at its lower end to the respective end 20 and an upper section 26 disposed in telescoping relation to the lower section. Stops 28 are provided to secure the upper post sections 26 in fixed vertical positions relative to their lower post sections 25. At the upper ends of the upper post sections 26 are forks 30 for receiving the ends of the bar 32 of a barbell 34 to support the latter on the posts 22. The upper post sections 26 are vertically adjustable to adjust the height of the barbell 34 above the bench 10.

The exercise apparatus described thus far is conventional except for the bench assembly 10 which constitutes the subject matter of this invention. This improved bench assembly of the invention will now be described.

Bench assembly 10 comprises a bench 36 proper and a supporting base 38 supporting the bench for adjustment toward and away from the barbell support frame 24. This adjustment constitutes an important feature of the invention which permits the bench 36 to be located in different positions relative to the barbell support 24 to accommodate different exercise routines.

According to another feature of the invention, the bench 36 has a seat portion 40, a backrest or back portion 42, and means 44 including an arcuate support 46 extending between the back and bench base 38 supporting the back portion for pivotal adjustment through a wide range of angles relative to the seat portion. Means 48 are provided for locking the back portion in fixed angular relation to the seat portion.

Referring now in more detail to the drawings, the bench supporting base 38 comprises a pedestal 50 including a generally upright column 52 welded or otherwise rigidly joined at its lower end to a plate 54. In the particular embodiment shown, the pedestal column 52 is inclined slightly for appearance sake. The pedestal plate 54 seats slidably on the top surface of the base member 16 which is a hollow rectangular tube. The top wall of this tube has a longitudinal slot 56. Seating slidably against the underside of the top wall of the base tube 16 is a plate 58, mounting screws 60 which extend upwardly through the tube slot 56 and holes in the pedestal plate 54. Knurled nuts 62 are threaded on the screws 60.

From the preceding description, it will be understood that the pedestal 50 is adjustable along the base 14, toward and away from the barbell support frame 24, by loosening the nuts 62. The pedestal may be secured in fixed position relative to the frame 24 by tightening the nuts 62.

The bench seat portion 40 has a rigid, flat rectangular body 64 with an upper cushion or pad 66. The seat body 64 is firmly attached in any convenient way to the upper end of the pedestal column 52 with the seat portion generally horizontal. The bench back portion 42 also has a rigid flat rectangular body 68 with a top cushion or pad 70. The back portion 42 is disposed at the end of the seat portion 40 adjacent the barbell frame 24. The back portion support means 44 comprises a hinge 72 pivotally joining the seat and back portions for rotation of the back portion about a pivot axis normal to the paper in FIG. 2. As noted earlier, the back support means 44 also comprises the arcuate support 46 which extends between the back portion 42 and the bench base 38. In the particular inventive embodiment under discussion, the arcuate support 46 comprises a pair of arcuate segments 74 which are pivotally attached at their upper ends by hinges 76 to the underside of the back portion 42. The lower ends of the segments straddle the pedestal column 52 and extend loosely or slidably through arcuate guides 78 at the outer sides of the column. The segments 74 and guides 78 are circularly curved about the pivot axis of the back portion hinge 72.

From this description it will be understood that during pivotal adjustment of the back portion 42 relative to the seat portion 40 of the exercise bench 10, the back support 46 undergoes endwise movement about the pivot axis of the hinge 72. The back portion is adjustable between its solid line upright position of FIG. 2 and its solid line declined position of FIG. 3 relative to the seat portion 40. Between these positions, is the broken line position of the back portion, shown in FIGS. 2 and 3, in which the back portion is horizontal and coplanar with the seat portion.

In the particular embodiment shown, the lock means 48 for locking the back portion 42 in adjusted angular position comprises a spring loaded detent device 80 engagable in notches 82 in the inner edges of the back support segments 74. The detent device 80 comprises a lock pin 84 slidable endwise in a bearing 86 fixed to the right-hand side of the pedestal column 52, as viewed in FIG. 2, and above the adjacent lower ends of the segments. Fixed to the upper end of the lock pin 84 is a lock pin pull rod 88. Rigid on the lower end of lock pin 84 is a cross pin 90 which forms a detent. This detent extends laterally over the adjacent lower ends of the support segments 74 and is engagable in the segment notches 82, which enter the upper edges of the segments, to lock the segments against endwise movement relative to the bench pedestal 50 and thereby lock the back portion 42 in adjusted angular position. The detent 90 is biased into locking engagement with the segments by means of a spring 92 in the bearing 86.

Figure 2:
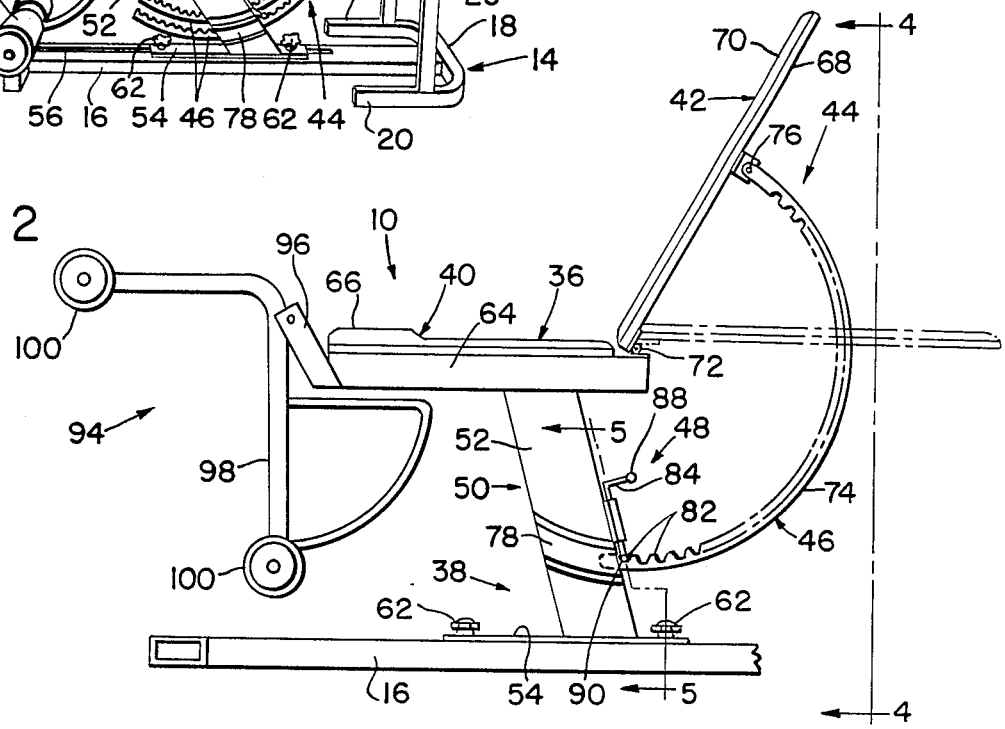
FIG. 2 is an enlarged side elevation of the bench in FIG. 1 with the bench adjusted to support the user in a sitting position.
Figure 3:
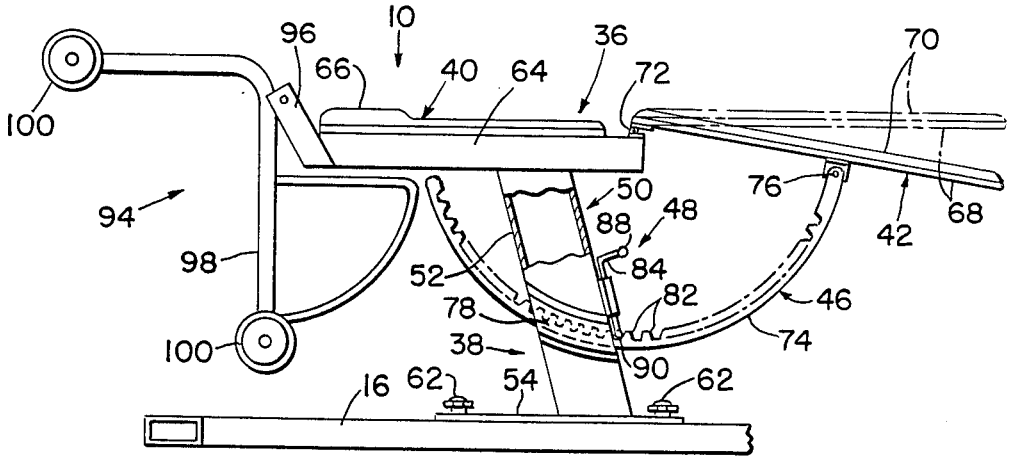
FIG. 3 is a view similar to FIG. 2 showing the bench in other positions of adjustment.
Figure 4:
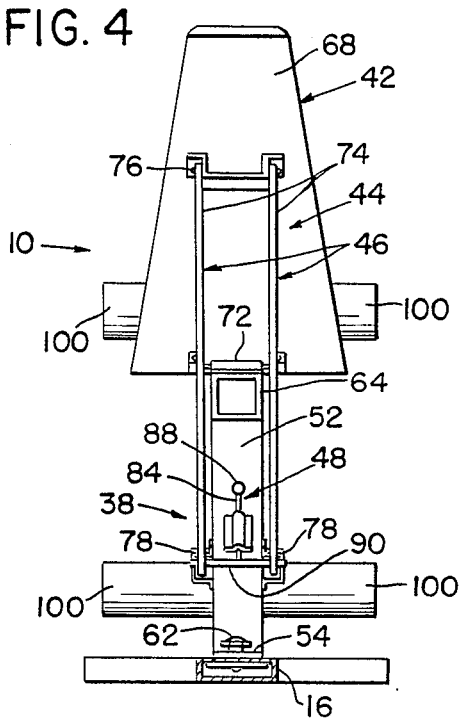
FIG. 4 is a view taken on line 4—4 in FIG. 2.
Figure 5:
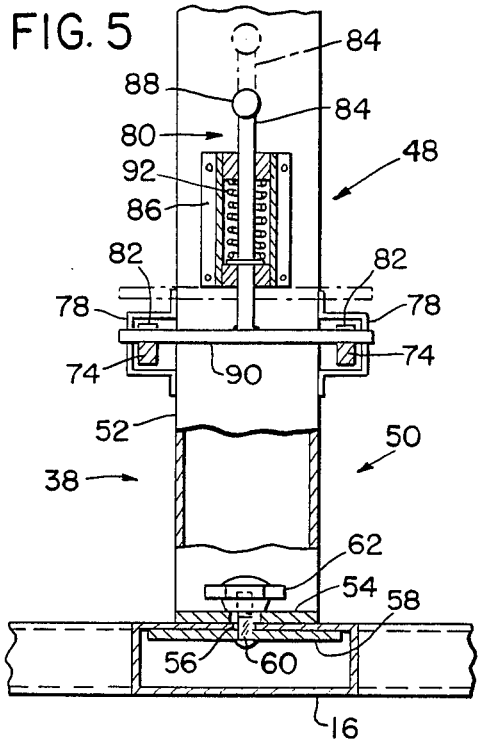
FIG. 5 is an enlarged section taken on line 5—5 in FIG. 2.

It is now evident that the back portion 42 of the exercise bench 10 is adjustable through a range of angular positions, between at least its solid line positions of FIGS. 2 and 3, by releasing the detent device 80. After adjustment, the back portion is locked in its adjusted position by releasing the detent device.

The exercise apparatus 12 in FIGS. 1–5 is also equipped with a leg exercise unit 94. This unit, like the remainder of the apparatus except the bench 10, is conventional and hence need not be described in detail. Suffice it to say the exercise unit 94 is pivotally mounted on brackets 96 secured to the end of the seat portion 40 opposite the barbell frame 24 and includes a frame 98 mounting weight rolls 100 for engagement by the user's legs.

The exercise apparatus 12 may be used in different ways. In FIG. 1, the back portion 42 of the bench 10 is adjusted to its horizontal position coplanar with the seat portion 40 to support the user in a horizontal reclining position. The bench 10 is adjusted longitudinally to position the user's shoulders near the barbell frame 24 so that the user, by stretching his arms upwardly as shown in FIG. 1, may remove a barbell 34 from and replace it in the forks 30 at the upper end of the frame. The user may raise and lower or otherwise move the barbell in the usual way to perform an exercise routine. As clearly shown in FIG. 1, the length of the bench 10 is such that the user's legs extend beyond the bench for operating the leg exerciser 94.

If desired barbell exercises may be performed with the back portion 42 of the bench 10 lowered to a declining position, such as that shown in full lines in FIG. 3. In this case it may be desirable to adjust the bench 10 longitudinally away from the barbell frame 24. Barbell and/or leg exercises may also be performed with the user in a sitting position. The back portion 42 of the bench is then adjusted to an upright position of FIG. 2. The bench may be longitudinally positioned as appropriate for the exercise involved. Obviously, the bench 10 of the invention may be used to perform exercises other than those mentioned above.

Figure 6:
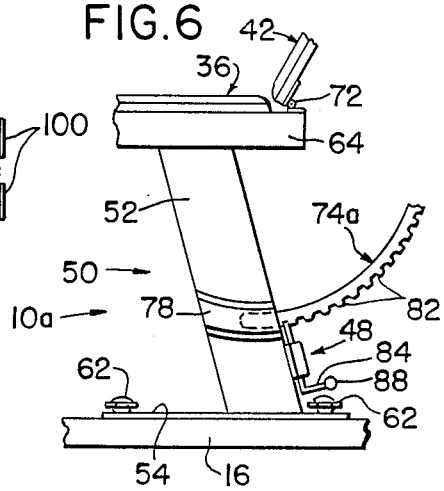
FIG. 6 is a fragmentary side elevation of a modified exercise bench according to the invention.
Figure 7:
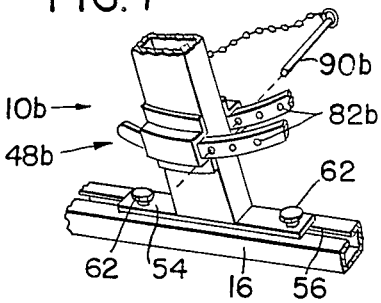
FIG. 7 is a fragmentary perspective view of a further modified bench according to the invention.

FIGS. 6 and 7 illustrate in fragmentary fashion two modified benches 10*a* and 10*b* according to the invention. Bench 10*a* is identical to the bench 10 of FIGS. 1–5 except that the locking or detent notches 82 in the back support segments, which are designated 74*a* in FIG. 6, are along the outer edges of the segments. The detent locking device 48 is mounted on the bench pedestal column 52 below the segments for locking engagement with the notches 82. The modified bench 10*a* is otherwise identical to bench 10.

Similarly the modified bench 10*b* of FIG. 7 is identical to bench 10 except for replacement of the locking means 48 of bench 10 by modified locking means 48*b*. These modified locking means comprise spaced holes 82*b* extending through the back support segments 74*b* for selectively recciving a lock pin 90*b*. Bench 10*b* is otherwise identical to bench 10.

Figure 9:
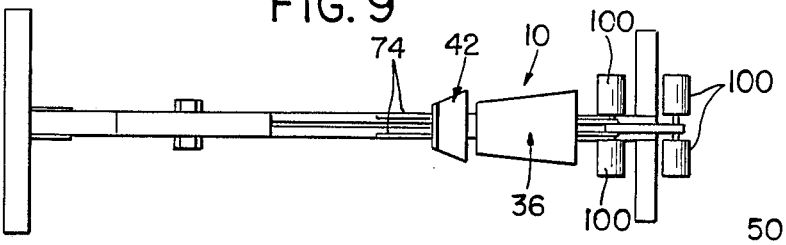
FIG. 9 is a top plan view of the exercise apparatus in FIG. 8.
Figure 8:
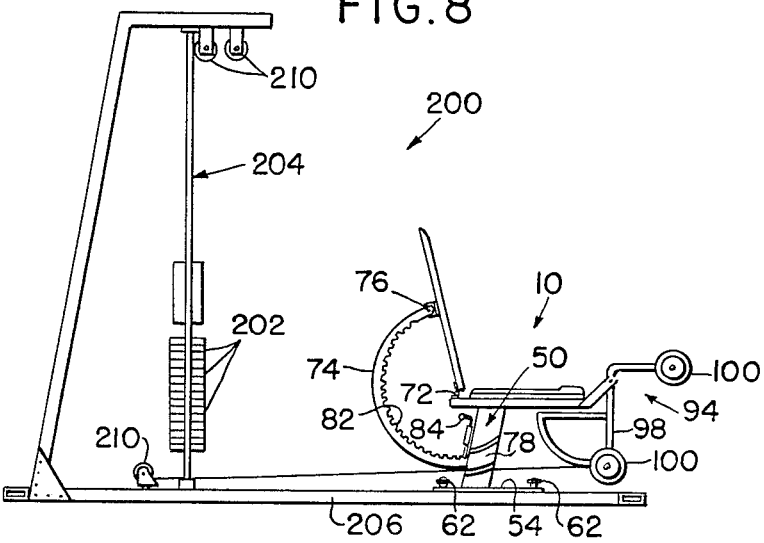
FIG. 8 is a side elevation of an exercise bench according to the invention installed in an exercise apparatus having frame mounted weights.

It will be immediately evident that the modified exercise benches 10*a*, 10*b* may be used in the exercise apparatus 12 in the same way as bench 10. It will be further evident that each of these benches may be used in other types of exercise apparatus. FIGS. 8 and 9, for example, illustrate the bench 10 of the invention installed in an exercise apparatus 200 including weights 202 mounted on an upright frame 204 for vertical movement relative to the frame. In this case, the bench pedestal 50 is attached by the pedestal screws 60 to a tubular base member 206 of the apparatus for adjustment toward and away from the weight frame 204 in the same manner as described earlier in connection with bench 10.

In the particular exercise apparatus 200 shown, the leg exerciser 94 is connected to the apparatus weights 202 by a cable 208. This cable extends from the exerciser frame 98 to the weights around appropriately located pulleys 210 in such a way that rotation exerciser frame raises and lowers the weights 202 along the apparatus frame 204. Means (not shown) are provided for selectively coupling any number of weights together to adjust the effective or total weight to be lifted. Obviously, the exercise apparatus 200 may be provided with other exercise devices that may be used by a person on the bench 10. Also, the exercise benches of the invention may be used with virtually any other type of exercise apparatus which has a bench.

The invention claims:

1. In an exercise apparatus, the combination comprising:

an elongate base member, a generally upright pedestal above said base member having a lower end adjacent the base member and an upper end, means mounting the lower end of said pedestal on said base member for adjustment of the pedestal along said base member, a bench including a seat portion mounted on the upper end of said pedestal, a back portion extending from said seat portion toward one end of said base member and beyond said pedestal, and means pivotally mounting said back portion on said seat portion for rotation of the back portion relative to said seat portion toward and away from said base member about a normally horizontal axis along an edge of the seat portion transverse to the base member, back support means including a back support member extending between said back portion and said pedestal for releasably securing said back portion in various angular positions relative to said seat portion, an upright weight support frame at said one end of said base member for supporting an exercise weight such as a barbell above the level of said bench, and wherein said bench and pedestal are adjustable as a unit lengthwise of said base member and toward and away from said support frame to locate said bench in a selected exercise position relative to said frame.

2. An exercise apparatus combination according to claim 1, including:

a leg exercise unit pivotally mounted along the opposite edge of said seat portion on an axis parallel to said first mentioned axis, and said back portion is angularly adjustable between a lower position wherein the back portion inclines toward said base member and a generally upright position wherein the back portion forms a backrest to support a user sitting on said seat portion in a position to use said leg exercise unit.

3. An exercise apparatus combination according to claim 1, wherein:

said back support member is fixed at one end to said back portion and is circularly curved about said axis, and said back support means comprises means engagable with the other end of said back support member for releasably securing the back support member to said pedestal with said back portion in various angular positions relative to said seat portion.

4. An exercise apparatus combination according to claim 3, wherein:

said back support member comprises a pair of circularly curved segments straddling said pedestal, and said pedestal includes guides through which said segments move endwise during angular adjustment of said back portion.

5. An exercise apparatus combination according to claim 4, wherein:

said back portion is angularly adjustable between a lower position wherein the back portion inclines downwardly toward said base member and an upper position wherein the back portion inclines upwardly away from said base member.

6. In an exercise apparatus, the combination comprising:

an elongate base member, a generally upright pedestal above said base member having a lower end adjacent the base member and an upper end, means mounting the lower end of said pedestal on said base member for adjustment of the pedestal along said base member, a bench including a seat portion mounted on the upper end of said pedestal, a back portion extending from said seat portion toward one end of said base member and beyond said pedestal, and means pivotally mounting said back portion on said seat portion for rotation of the back portion relative to said seat portion toward and away from said base member about a normally horizontal axis along an edge of said seat portion transverse to the base member, back support means including a back support member extending between said back portion and said pedestal for releasably securing said back portion in various angular positions relative to said seat portion, and wherein said bench and pedestal are adjustable as a unit lengthwise of said base member.

7. An exercise apparatus combination according to claim 6, including a leg exercise unit pivotally mounted along the opposite edge of said seat portion on an axis parallel to said first mentioned axis, and said back portion is angularly adjustable between a lower position wherein the back portion inclines toward said base member and a generally upright position wherein the back portion forms a backrest to support a user sitting on said seat portion in a position to use said leg exercise unit.

* * * * *